United States Patent [19]

Rohr

[11] Patent Number: 4,479,447

[45] Date of Patent: Oct. 30, 1984

[54] METHOD AND APPARATUS FOR SEWING ON A TUBULAR WORKPIECE EDGE

[75] Inventor: Günter H. Rohr, Hemmingen, Fed. Rep. of Germany

[73] Assignee: Union Special GmbH, Stuttgart, Fed. Rep. of Germany

[21] Appl. No.: 391,332

[22] Filed: Jun. 23, 1982

[30] Foreign Application Priority Data

Jun. 26, 1981 [DE] Fed. Rep. of Germany ..... 3125125

[51] Int. Cl.[3] ..... D05B 35/02

[52] U.S. Cl. ..... 112/141; 112/147; 112/262.2; 112/63

[58] Field of Search ..... 112/262.2, 121.15, 121.26, 112/121.27, 121.11, 141, 147, 136, 153, 121.29, 305, 306, 262.1, 63

[56] References Cited

U.S. PATENT DOCUMENTS

| | | | |
|---|---|---|---|
| 3,736,895 | 6/1973 | Farrar et al. | 112/147 |
| 3,970,014 | 7/1976 | Chano et al. | 112/121.11 |
| 4,098,201 | 7/1978 | Adamski, Jr. et al. | 112/262.2 X |
| 4,098,204 | 7/1978 | Kojima | 112/147 X |
| 4,359,953 | 11/1982 | Martell et al. | 112/121.11 |

*Primary Examiner*—Peter Nerbun

*Attorney, Agent, or Firm*—John W. Harbst; John A. Schaerli

[57] ABSTRACT

The disclosed invention describes an automatic sewing machine adapted to sew along a tubular workpiece edge. Upon insertion, the workpiece is tensioned and the marginal edge thereof is arranged in a different shape before sewing than after sewing. An array of sensors are positioned to monitor and effectively control the lateral disposition of the workpiece edge during the entirety of the sewing cycle and to effect an uninterrupted working sequence without the need of operator intervention.

12 Claims, 3 Drawing Figures

METHOD AND APPARATUS FOR SEWING ON A TUBULAR WORKPIECE EDGE

FIELD OF THE INVENTION

The present invention relates to sewing machines and, more particularly, to an apparatus and method for automatically sewing along the free edge of a looped or tubular workpiece.

BACKGROUND OF THE INVENTION

The shape of a tubular or closed loop workpiece makes operator handling difficult and cumbersome. Often, such workpieces must be sewn by hand or are manually guided to the stitch forming means of the sewing machine to assure proper workpiece fabrication. Even though guides may be used in some applications, such manually manipulation is timely and expensive.

On those devices where the workpiece edge is automatically sewn, workpiece edge alignment is achieved only within a predetermined range. Because the workpiece advancement is often halted in such automatic operations, the sewing unit has a relatively long cycle time. Also, with such devices, manual skill remains necessary in order to insert the workpiece and to position it correctly. Tubular workpieces having a wavy or ragged edge cannot be satisfactory processed on such known sewing units.

SUMMARY OF THE INVENTION

In view of the above, and in accordance with the present invention, there is provided an automatic sewing machine which is designed to work on tubular workpieces. The automatic sewing machine of this invention includes tensioning means for supporting and feeding the workpiece edge past the stitch forming means as well as work alignment means that operate in conjunction with the support and feeding mechanisms in maintaining proper orientation of the workpiece edge. Further included is a unique control device which is effective from the start to the end of the sewing cycle to assure proper alignment of the workpiece edge.

The apparatus for controlling machine operation includes an array of sensor means which are linked to a control program for initiating various sequences throughout the sewing cycle. The array of sensor means include first, second and third sensor means. The first sensor means being disposed in advance of the stitch forming means and adapted to influence the lateral disposition of the workpiece edge by controlling the work alignment apparatus. The lateral disposition of the first sensor means relative the sewing area generally corresponds to the nominal or desired position of the initial or unfolded workpiece edge. Another second sensor means is disposed laterally of the stitch forming means in a position generally corresponding to the nominal or desired position of the workpiece edge when said edge is in its final state. The other sensor means is also effective to influence the lateral disposition of the workpiece edge by controlling the work alignment apparatus. This other sensor means is disposed intermediate the first and second sensor means. The third sensor means is responsive to a transitional state of the workpiece edge between its initial and final state. The third sensor means controls the operation and effectiveness of the first and second sensor means.

With the present invention, the machine is automatically actuated upon insertion of a workpiece into the sewing area. The machine operates along the workpiece edge without interruption up to the end of the seam, and the workpiece edge is aligned to a predetermined position over the entire circumference of the workpiece edge.

In line with the above, it is a primary objection of this invention to provide a method for sewing of a tubular workpiece edge which can be preformed fully automatically.

Another object of this invention is to provide a mechanical apparatus to perform such an edge sewing operation.

A further object of this invention is to provide a system which requires minimum skill for efficient and effective operation.

A further object of this invention is to provide a system which may effectively and efficiently circumferentially sew a tubular workpiece edge in a minimum amount of time and with no operator interference.

BRIEF DESCRIPTION OF THE DRAWINGS

Having in mind the above objects and other attendent advantages that would be evident from an understanding of this disclosure, the invention comprises the devices, combinations, and arrangements of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
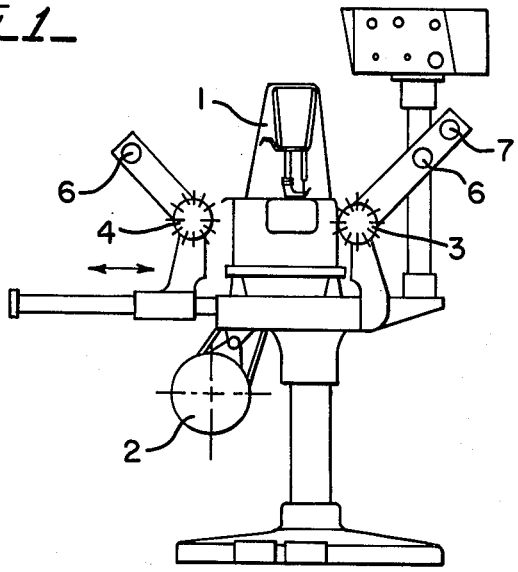
FIG. 1 is a diagrammatic illustration of the sewing apparatus.

Referring now to the drawings wherein like reference numerals indicate like parts throughout the several views, the mechanical portion of a program controlled automatic sewing machine according to the invention is shown in FIG. 1. The sewing unit shown in FIG. 1 is substantially the same as that disclosed in my co-pending U.S. patent application, Ser. No. 372,366 filed Apr. 26, 1982 all the teachings of which are herein incorporated by reference. Suffice it to say, the sewing unit includes a sewing machine 1 having reciprocal needle means defining a sewing zone or area, a presser foot, means for raising and lowering the presser foot, means for severing the threads and a synchronization unit arranged on the hand wheel of the machine for positioning the needle means. All of these various machine components being well known in the art and thus no further discussion will be devoted thereto. Arranged in conjunction with the synchronization unit is a drive motor or transmitter 2 which serves to power the sewing machine 1.

The present invention is primarily used in preparing tubular workpieces. In that such workpieces are generally soft and stretchy, and their bulk and weight could interfere with its handling and guidance, an apparatus which supports the workpiece in a tubular or endless loop configuration and facilitates operation of the machine 1 is provided and will now be described. As described in detail in my above-mentioned co-pending application, the support apparatus includes a pair of rotational, cylinder like support and guiding or positioning assemblies 3 and 4 that are disposed on opposite sides of the stitch forming means of the sewing machine 1. Preferably, each of the workpiece support mechanisms are driven by a motor 6 and are adapted to linearly advance the tubular workpiece edge past the stitch forming means of the sewing machine. In the embodiment shown, the workpiece holder or support 3 is fixed relative to the machine 1. The other workpiece support or tensioning mechanism 4 is axially movable between operative and non-operative positions in the direction of the arrow shown in FIG. 1. In this manner, a tubular workpiece may be positioned over the work supports 3 and 4 and is subjected to a light tension or stretching when the support mechanisms are separated under the influence of a drive mechanism (not shown). As described in my co-pending application, alignment or guide means are cooperatively arranged for association with the work support and feeding mechanism. A motor 7 is provided for influencing the operation of the alignment or guide apparatus. The alignment means are effective to displace the workpiece edge transversely of the line of stitch formation or line of stitches. Although it is preferable to have both support assemblies provided with an alignment apparatus, the mechanism will also be effective if only one alignment apparatus is provided.

Figure 2:
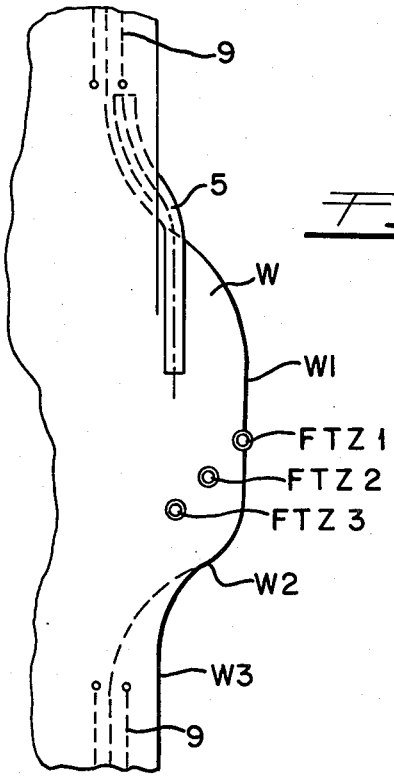
FIG. 2 is a diagrammatic illustration of the sensor array.

As best illustrated in FIG. 2, means are provided for folding back or hemming the marginal edge of the workpiece W being shown. That is, a helical or spiral-like wire 5 serves to engage and turn or fold-in the initial or raw edge of the tubular workpiece whereby creating a fold in the workpiece edge. The folded edge is then to be secured by a line of stitches or seam 9 which extends substantially parallel with the folded workpiece edge.

Figure 3:
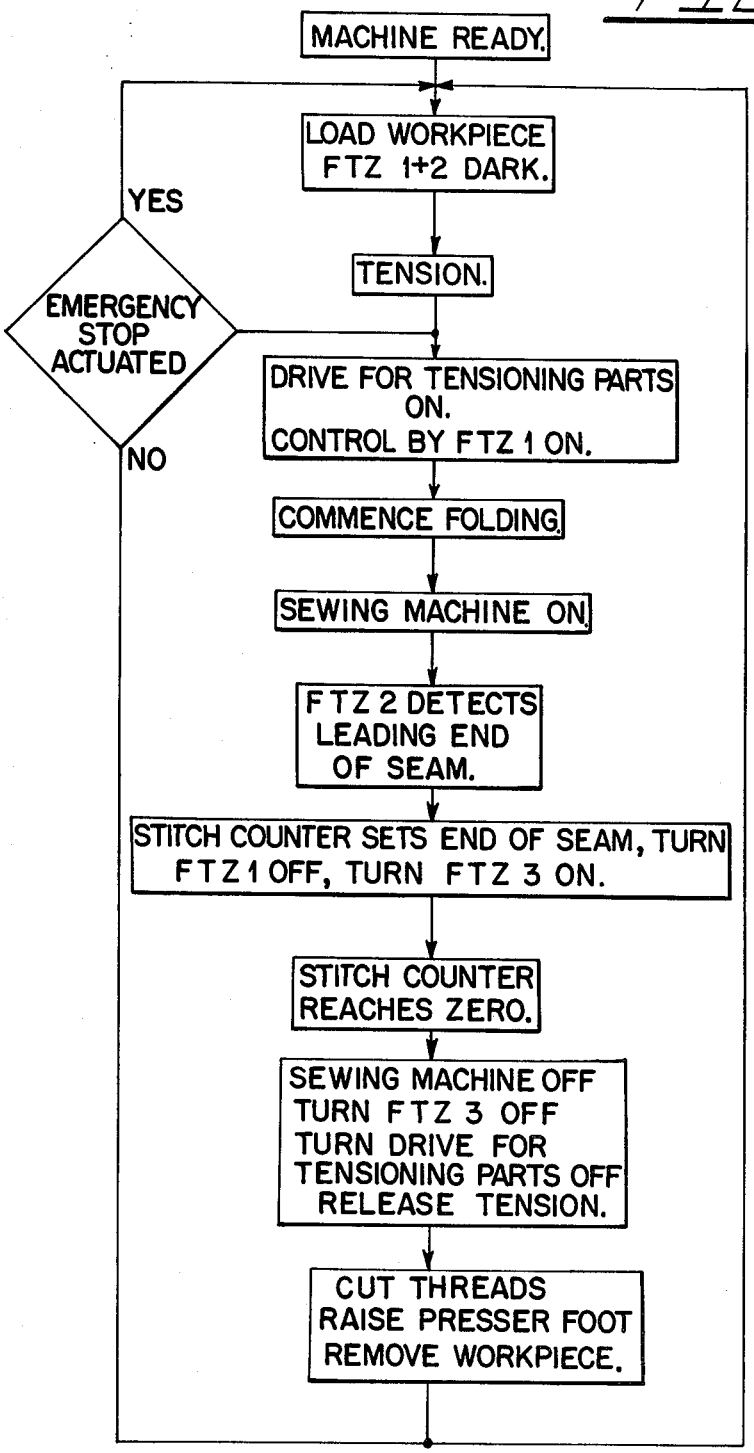
FIG. 3 is a schematic diagram of the working sequence.

After the tubular workpiece W has been situated over the support means 3 and 4, the entire sewing operation is effected automatically without interruption or operator intervention. The operator need only insert the garment into the machine and remove same upon completion of the sewing cycle. The sewing operation is carried out under the influence of a program which is schematically shown in FIG. 3. The program and various individual sewing sequences respond to output signals received from an array of sensor means or devices including sensor means FTZ 1, FTZ 2 and FTZ 3. Such sensor means or monitor means may be of any suitable construction, a photosensitive or photoelectric type being preferred in this construction. As best seen in FIG. 2, the sensor means are located at varying lateral positions on the upstream side of the sewing machine; that is, in advance of the stitch forming means of the machine. The position of sensor means FTZ 1 generally corresponds to the nominal or desired position for a workpiece edge in its initial or unfolded state. The position of sensor means FTZ 3 generally corresponds to the nominal or desired position for a workpiece edge which has been arranged in its final state. The sensor means FTZ 2 is interposed evenly between the sensor means FTZ 1 and FTZ 3.

In operation, the operator initially places a tubular workpiece over the workpiece support and feeder mechanisms 3 and 4 such that both sensor means FTZ 1 and FTZ 2 are masked or covered. Masking of the sensor means FTZ 1 and FTZ 2 causes initial displacement of the mechanism 4 into its operative position whereby triggering initiation of the sewing cycle. Displacement of the mechanism 4 ultimately tensions the workpiece edge to a predetermined value. Having tensioned the workpiece, the drive 6 for the support mechanisms is initiated whereby effecting linear displacement of the workpiece edge past the stitch forming means. Also, the motor 7 for the work engagable guide means is actuated.

As a result of the actuation of the workpiece support mechanism, the workpiece edge is linearly displaced past the folding element 5. The folding element folds and aligns the marginal edge at a predetermined lateral distance relative to the stitch forming means of the mechanism. At the same time, the alignment mechanism is effective to arrange the disposition of the workpiece edge W 1 relative to a predetermined point. To accomplish this end and to insure a continued line of stitching which extends parallel to the finished or folded edge, the workpiece edge W 1 may be continuously oscillated back and forth relative to its desired position. Oscillation of the workpiece edge may be obtained since the alignment means can effectively displace the workpiece edge to mask or unmask the sensor FTZ 1 which, in turn, controls the alignment apparatus. The masking of sensor FTZ 1 ultimately results in actuation of the sewing machine 1, although such actuation may be delayed relative to the activation of the worksupport mechanisms and the alignment apparatus. The delay can be in the form of a timing circuit or counter which activates the sewing machine 1 to commence formation of the seam in the hem as a function of the operation of the work engagable guide means; that is, after the direction of the rotation of motor 7 has been changed a predetermined number of times. The raised presser foot of the machine is also lowered upon activation of the machine or with a slight delay relative thereto. Thus, the sewing operation commences while the workpiece is moved past the stitch forming means by the support and feeding mechanisms at the sewing speed.

Upon activation of the sewing machine, the sensor means FTZ 2 is rendered inoperative for a predetermined period of time. Such period of time is adjustable and is somewhat shorter than the period of time required for the circumference of the tubular workpiece edge W to make one revolution around the tensioning parts 3 and 4. Thus, the program which is effected at the trailing end of seam 9, is prevented from being unintentionally initiated as may happen when operating along a very irregular workpiece edge. Preferably, timing means are provided which, only after the above-mentioned predetermined period of time has expired, will allow a signal to pass such that the sensor means FTZ 2 is again activated. In this manner, the end of the seam or stitching program is only initiated when the sensor means FTZ 2 senses the trailing portion of the workpiece edge, referred to in FIG. 2 as W 2, in advance of the leading or initial end of seam 9.

When the end portion W 2 of the workpiece unmasks the sensor means FTZ 2 it causes a change of state thereof whereby sensor means FTZ 1 is rendered inoperative and the sensor means FTZ 3 is rendered operative. Continued progression of the finished edge W 3 past the sensor means FTZ 3 sets the program into a "finish" mode and controls the rest of the progress of seam 9. That is, sensor means FTZ 3 senses that the workpiece edge has made a complete revolution past the stitch forming means and is sensed by initial seam approaching the sensor FTZ 3. Once the sensor means FTZ 3 senses that a complete revolution of the workpiece edge has been accomplished, a predetermined number of stitches are completed, the sewing machine is switched off, the workpiece support and feeding mechanisms 3 and 4 and the alignment apparatus are deactivated. Also, the tension on the workpiece is released by the return of the mechanism 4 to its inoperative position. At approximately the same time, the threads are cut and the presser foot is raised to allow the workpiece to be subsequently removed from the machine.

A complete understanding of the instant invention reveals that the apparatus of this invention is not confined to the hemming of a workpiece. It can also be used for sewing on a tape or the like when the tape extends a greater lateral distance from the workpiece than when in the sewn state.

Thus there has been provided a Method and Apparatus For Sewing On A Tubular Workpiece Edge which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having thus adequately described my invention, what I claim is:

1. In combination with an automatic sewing machine having a presser mechanism including a presser foot, a device for folding back the marginal edge of a tubular workpiece, stitch forming means adapted to operate on the folded edge of the workpiece, mechanism for supporting and linearly feeding the workpiece edge to the stitch forming means, work engagable guide means cooperative with the support and feeding mechanism to position the workpiece edge, and a control device for said automatic sewing machine, said control device comprising:

an array of sensor means including a first sensor means being disposed in advance of the stitch forming means in the direction of sewing and laterally spaced therefrom in a position corresponding substantially to the nominal position of an unfolded workpiece edge, a second sensor means being laterally disposed relative to said stitch forming means in a position corresponding substantially to the nominal position of a folded workpiece edge, a third sensor means disposed between said first and second sensor means for detecting the transition of the workpiece edge between unfolded and folded positions and for directing the effectiveness of said first and second sensor means in response thereto; and means responsive to said array of sensor means for controlling said work engagable guide means and sewing machine operation.

2. The invention according to claim 1 wherein said supporting and feeding mechanism includes a pair of rotatable cylinder-like workpiece holders disposed on opposite sides of the stitch forming means for receiving and slidably supporting the workpiece.

3. The invention according to claim 2 wherein at least one of said workpiece holders is controllably shiftable between operative and non-operative positions in response to a resultant signal derived from said first and third sensor means.

4. The invention according to claim 3 wherein the shifting of the workpiece holder to its operative position triggers initiation of a sewing cycle including effecting linear displacement of the workpiece edge past the stitch forming means of the machine and actuation of the work engagable guide means.

5. The invention according to claim 4 wherein the linear displacement of the workpiece edge and actuation of the work engagable guide means precede actuation of the sewing machine.

6. The invention according to claim 5 wherein the time interval between initial linear displacement of the workpiece edge past the stitch forming means and actuation of the sewing machine is adjustable.

7. The invention according to claim 5 wherein said time interval is a function of the operation of the work engagable guide means.

8. The invention according to claim 1 wherein the control device further includes means for raising and lowering said presser foot in timed relation with the sewing machine actuation.

9. The invention according to claim 8 wherein the effect of lowering the presser foot into the workpiece is delayed with respect to the actuation of the sewing machine.

10. The invention according to claim 1 wherein said means responsive includes additional means for shifting the control of the sewing machine from the first sensor means to the second sensor means in response to a change of state of said third sensor means and for initiating a final phase of the sewing operation.

11. A method for operating on a tubular workpiece edge with a sewing machine, said method comprising the steps of:

tensioning the edge of a tubular workpiece;

turning back the marginal edge of the tubular workpiece;

sensing and controlling machine operation as a function of the lateral position of the unfolded workpiece edge relative to a predetermined point for a portion of the sewing machine operation;

securing the turned back edge to the remainder of the workpiece with said sewing machine creating a sewn seam;

sensing the leading end of the sewn seam in advance of the position whereat the turned back edge is secured to the remainder of the workpiece; and sensing and controlling machine operation as a function of the lateral position of the folded workpiece edge relative to a predetermined point for the remainder of the machine operation.

12. An automatic sewing machine for sewing along a tubular workpiece edge comprising:

mechanism for supporting the workpiece in a tubular configuration and capable of advancing a marginal edge of the workpiece through the sewing machine;

a work engagable guide mechanism cooperative with the feeding mechanism and capable of influencing the lateral disposition of the workpiece edge;

means for forming a hem in the workpiece edge; and means for automatically controlling the sewing machine, said control means including in combination first operative means for monitoring the unhemmed edge's lateral disposition, second operative means for monitoring the hemmed edge's lateral disposition, third operative means responsive to a difference between the advancing hemmed and unhemmed edge's lateral disposition, said third operative means initially controlling movement of the workpiece edge through the sewing machine as a function of the unhemmed edge's lateral disposition and subsequently controlling movement of the workpiece edge through the sewing machine as a function of the hemmed edge's lateral disposition.

* * * * *